United States Patent [19]

Kinzler et al.

[11] 4,136,804

[45] Jan. 30, 1979

[54] GRAVITY MOTIVATED HOPPER

[75] Inventors: Raymond C. Kinzler, Carnegie; Harry R. Bartlebaugh, Gibsonia, both of Pa.

[73] Assignee: Koppers Company, Inc., Pittsburgh, Pa.

[21] Appl. No.: 891,013

[22] Filed: Mar. 28, 1978

[51] Int. Cl.[2] ..... B65G 65/70

[52] U.S. Cl. ..... 222/547; 214/17 A; 222/506; 222/564

[58] Field of Search ..... 214/17 R, 17 A, 17 C; 105/282, 247; 222/447, 450, 506, 545, 564, 547, 1

[56] References Cited

U.S. PATENT DOCUMENTS

| | | | |
|---|---|---|---|
| Re. 29,385 | 9/1977 | Mitsitz | 222/1 X |
| 3,682,339 | 8/1972 | Knappstein | 222/58 X |
| 3,901,419 | 8/1975 | Szendroi | 222/506 |
| 4,060,183 | 11/1977 | Puurunen | 222/450 X |
| 4,066,107 | 1/1978 | Karp et al. | 222/447 X |

FOREIGN PATENT DOCUMENTS

| | | | |
|---|---|---|---|
| 848643 | 9/1952 | Fed. Rep. of Germany | 222/506 UX |

*Primary Examiner*—David A. Scherbel

*Attorney, Agent, or Firm*—Herbert J. Zeh, Jr.; Oscar B. Brumback

[57] ABSTRACT

A gravity motivated hopper with the capacity to alleviate arching of granular material contained in the hopper. The hopper has a lower section defining a flow path which is vertically oriented with vertically decreasing horizontal cross-sectional areas leading to a bottom opening. In the proximity of the bottom opening is a first gate mechanism. The first gate is located below the critical arching cross-sectional flow area of the granular material, and functions to restrain the material during charging of the hopper and hopper transport, or permit flow of the material from the hopper during hopper discharge. Placed above the bottom gate is a second gate mechanism. The second gate is placed above the critical arching cross-sectional flow area for the particular granulated material. The second gate allows a certain volume of granular material to pass through during charging of the hopper while supporting the remaining portion of the granular material to deprive the granular material of arching condition during hopper charge and transport. The second gate will further permit unobstructed hopper discharge of the granular material.

3 Claims, 7 Drawing Figures

GRAVITY MOTIVATED HOPPER

BACKGROUND OF THE INVENTION

This invention relates to hoppers and, more particularly, to gravity motivated batch type hoppers for handling bulk material, for example, hoppers used in charging coke ovens.

Hoppers which are charged with batch quantities of a material are referred to as batch type hoppers. If the hopper depends upon gravity to motivate contained material through an opening in its lower portion, it is referred to as gravity motivated or operated hopper. Hoppers are commonly employed to handle bulk materials that are granular solids of varying particulate sizes, as, for example, crushed coal or cement, flour, clay and soil.

During the discharge of gravity motivated hoppers, a serious problem, referred to as arching or bridging, can occur. Arching occurs when a portion of the material in the hopper becomes consolidated and forms a stable arch which extends between the walls of the hopper and prevents or retards the discharge of the remaining material from the hopper. Consolidation is used in reference to the action of such material. Consolidation is influenced by many factors. One factor is the average particulate size of the material. Additional factors are moisture content of the material and material compaction. Compaction refers to the conditioning which results from successive layers of material being charged, layer upon layer, into the hopper.

Many approaches have been tried in order to eliminate arching, for example, selection of hopper construction material to minimize friction, design of a hopper to include steep walls and use of vibrators. Each of these approaches has met with limited success.

The size of the discharge opening can be carefully selected to take into consideration the flow characteristics of the material to be handled by a hopper as the flow characteristics of the particular granular material can be measured and used to predict the minimum size of a bottom discharge opening, which will prevent the formulation of a stable arch. This minimum size is equal to the critical arching dimension, or arch cross-sectional flow area. If the opening is equal to the crital arching dimension, a stable arch will not form in the hopper above it. However, if the opening is smaller than the critical arch dimension, a stable arch can form. Frequently the size of the discharge opening is required to be smaller than the critical arching dimension. The size of the discharge opening often fixed by external factors such that the size of the charging opening with which the hopper must correspond, or dimensions of a receptacle which is to be charged by the hopper. Various types of internally mounted static flow promotion devices have been tried. These devices have taken the form of flat plates, cones and cylinders, to name a few, and are generally mounted inside the hopper above the discharge opening. Such static devices help prevent arching by minimizing consolidation of the material during and after charging. Material falling into the empty hopper arrives at the bottom after being slowed down by striking the device, therefore, the device continues to absorb part of kinetic energy of the falling material, as well as support part of the material after charging is complete.

While the static devices have helped to prevent arching problems, they also create problems. Arching of material tends to occur in the area between such devices and the hopper wall. Thus, while preventing arching in one area of the hopper, the static device may actually create a structure which can lead to arching in another location. Also, the static devices affect the downward flow of material directly above the device. This affect can have the result of slowing the speed of discharge of the hopper affecting system performance for which the hopper can be an integral part.

Gravity operated batch type hoppers are widely used as a part of the charging machine to charge coke ovens. Here, the arching problems associated with these hoppers are not only present but are aggravated by conditions found in coke oven operations. For instance, arching can result from compaction due to charging of crushed coal from the storage bin into the hopper carried on a larry car charging machine. In addition, increased consolidation takes place due to vibration when the larry car moves from the charging bin to a charging hole in the coke oven furnace. As the amount of moisture present in the coal increases, the danger of arching increases considerably due to the presence of coal dust which, affected by moisture, forms an adhesive agent.

Arching can cause insufficient material to be charged into the coke oven, resulting in lost production and less uniform coke quantity. Finally, prolonged hopper discharge time due to arching can result in increased amount of pollutant gases escaping from furnace interior.

The present invention alleviates the arching problem without inhibiting the hopper discharge time.

SUMMARY OF THE INVENTION

A gravity motivated hopper with the capacity to alleviate arching of a contained granular material has a hollow interior with a lower section forming a flow path to a bottom opening. The flow path vertically decreases in horizontal cross-sectional area to the bottom opening such that the critical arching dimension for the contained granular material is within the hopper's lower section.

The hopper has a minimum of two gates. One of the gates is placed in proximity to the bottom opening below the critical arching dimension to either restrict or permit flow of the granular material from the hopper. A second gate is mounted to the hopper. The second gate can assume a position to permit unobstructed flow or slidably repositioned to obstructed flow through the gate. When the second gate assumes an obstruction position to the flow path, partial support for the granular material above the second gate is provided, alleviating the tendency for the granular material to compact and consolidate.

During discharge of the hopper, the second gate is delay-activated to assure the granular material does not arch. The time delay is calculated as not to inhibit hopper discharge time. In addition, second gate members are exchangeable to match the characteristics of the particular granular material, e.g., average particulate size and moisture content, to further assure the granular material does not arch.

DETAILED DESCRIPTION OF THE PREFERRED EMBODIMENT

Figure 1:
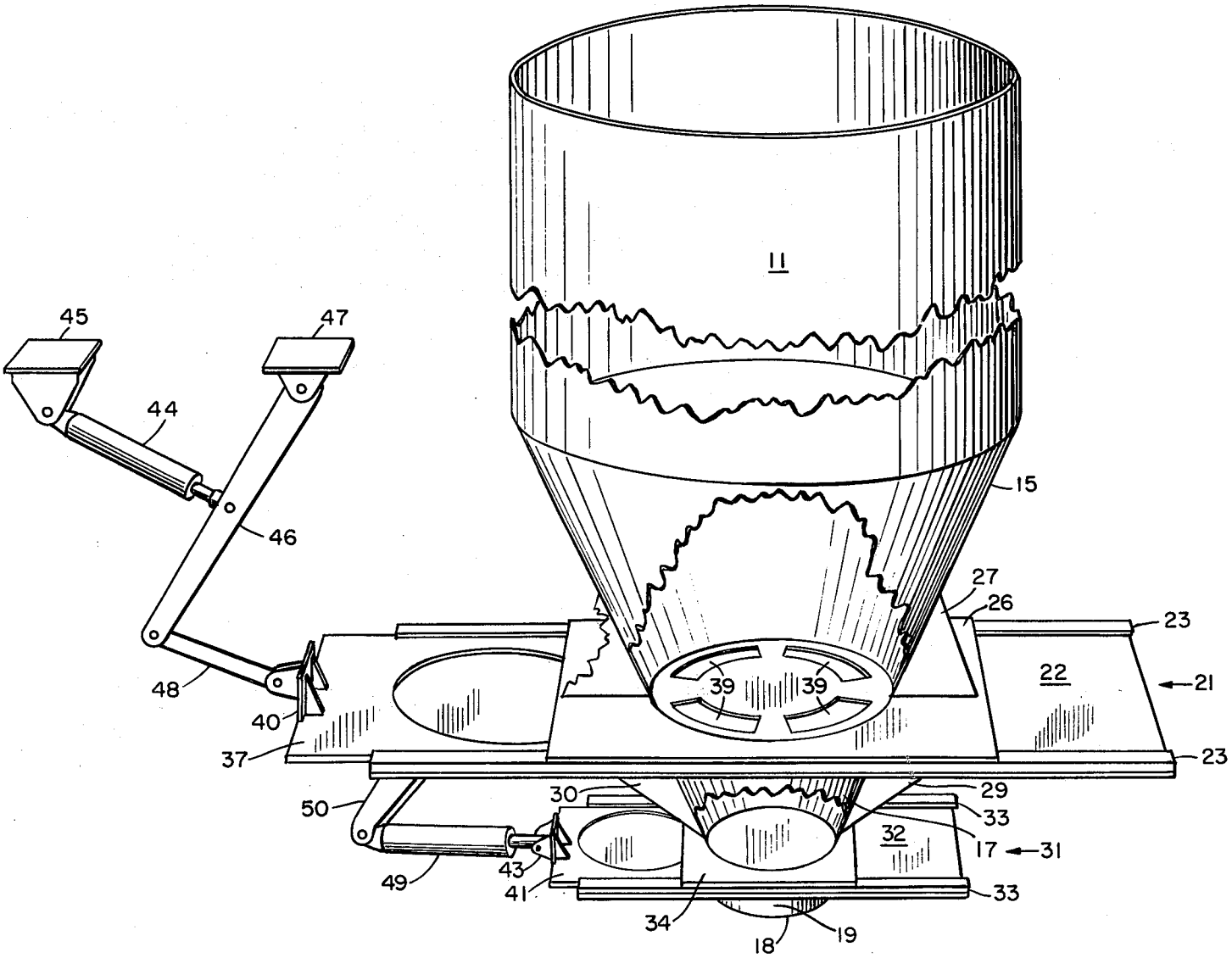
FIG. 1 is a perspective view, with sections removed, of the gravity motivated hopper.

Referring to FIG. 1, an embodiment of a gravity motivated hopper 11 in a conventional manner is mounted to and supported by a support structure (hereinafter a larry car will be referred to as indicative of a support structure). Hopper 11 is vertically oriented and hollow, having a lower portion comprised of a plurality of sections 15, 17 and 19. These sections 15, 17 and 19 are vertically oriented and define a containment area or flow path which is characterized by vertically decreasing horizontal cross-sectional flow areas. Material from section 15 feeds into section 17, and from there into section 19 and then out of hopper bottom opening 18.

Hopper section 17 is sized to reflect the critical arching dimension for the particular granular material expected to be housed by hopper 11. The flow path defined by hopper section 17, as illustrated in FIG. 1, is funnel-shaped of sufficient slope and length to assure the location of the critical arching dimension therein.

Figure 2:
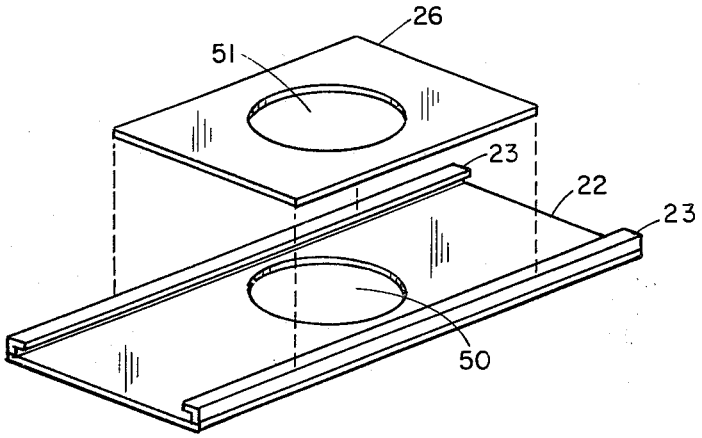
FIG. 2 is an exploded view of the second gate guide assembly.

A gate assembly 21, having a generally rectangular guide plate 22 of uniform thickness, is horizontally mounted between sections 15 and 17. Referring to FIG. 2, guide plate 22 has aperture 50 off-set to the right in plate 22 and extending throughout the thickness of plate 22. The radius of hole 50 is approximately equal to the radius of the flow path at the intersection of section 15 and 17. Running lengthwise along each longitudinal edge of the guide plate 22 are guide bars 23. A plate 26 is placed above the hole 50 in guide plate 22. Plate 26 is fixably mounted to guide bars 23 by any conventional means, such as welding. Plate 26 has a hole 51 aligned with and equal in size to the hole contained in guide plate 22.

Figure 3:
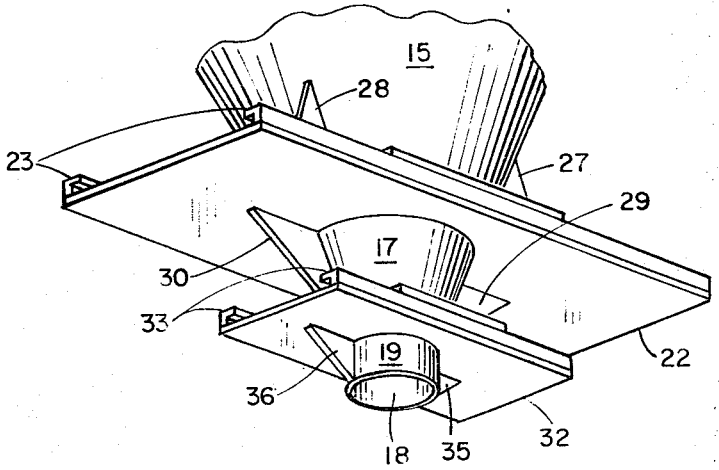
FIG. 3 is a perspective view of the underside lower section of the hopper.

A material may pass from hopper section 15 to hopper section 17 through holes 51 and 52 (refer to FIGS. 1 and 3). Guide plate 22 is mounted to hopper section 15 and 17 by means of flanges 28, 27, 30 and 29. Flanges 28 and 27 are fixably mounted by any conventional means to plate 26 and to the side hopper section 15. Flanges 30 and 29 are fixably mounted by any conventional means to the under side of plate 22 and to the side of hopper section 17.

Figure 4:
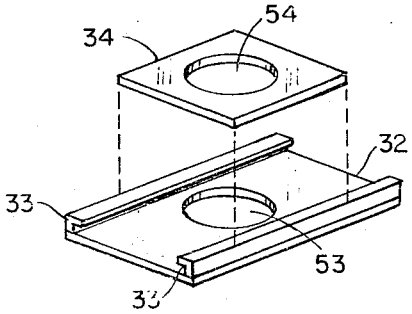
FIG. 4 is an exploded view of the first gate guide assembly.

Between hopper sections 17 and 19 is gate assembly 31, FIGS. 1 and 4, which includes a generally rectangular-shaped guide plate 32 of uniform thickness, which has guide bars 33 fixably mounted to and extending lengthwise along each longitudinal edge of guide plate 32. Guide plate 32 contains a hole 53 which extends throughout the thickness of plate 32. Hole 53 has a radius approximately equal to that of the flow path at the intersection of hopper sections 17 and 19. A plate 34 is fixably mounted to guidance bars 33 which are affixed to plate 32. Plate 34 has a hole 54 aligned to and equal in radius to hole 53. Guide plate 32 is positioned between hopper sections 17 and 19 to allow material passage from hopper section 17 to hopper section 19 through the holes 53 and 54. Guide plate 32 is supported by flanges 35 and 36. Flanges 35 and 36 are fixably mounted by conventional means to the under side of guide plate 32 and to the side hopper section 19 (refer to FIG. 3).

Figure 5:
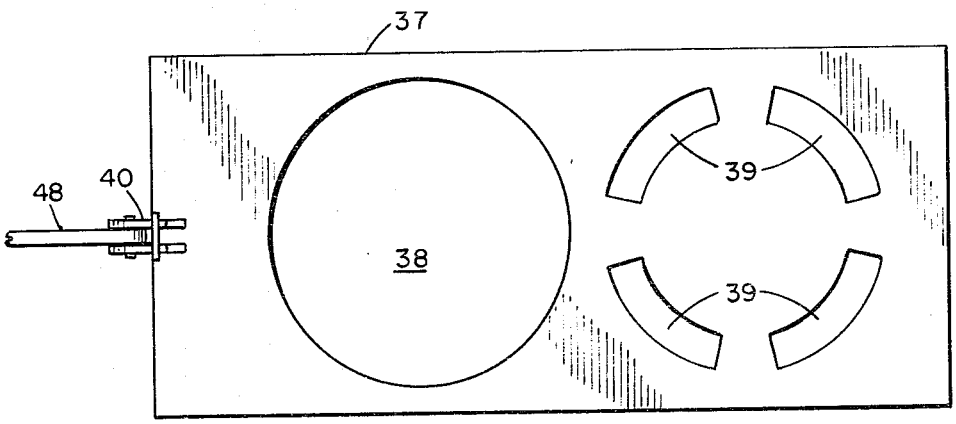
FIG. 5 is a top view of the second gate member.

A gate member 37, FIGS. 5 and 1, is slidably mounted to guide bars 23 of plate 22 and has a generally rectangular configuration with a hole 38 extending throughout the plate thickness. Hole 38 is placed off-set to the right, as viewed in FIG. 5, on gate member 37. To the right of hole 38 are a plurality of arched slots 39 arranged in a circular configuration. The radius of hole 38 is equal to the radius of hole 50. The radius of the circular configuration created by slots 39 is slightly less than hole 50. Fixably mounted to the left longitudinal extreme of gate member 37 is a pivot member 40. Gate member 37 is coupled to a hydraulic cylinder 44 which motivates gate member 37 to assume different positions along guide plate 22.

Hydraulic cylinder 44 has one end mounted to pivot 45 which is, in turn, fixably mounted to the larry car structure (not shown) and the other end pin mounted to a pivot arm 46 which is pivotally mounted at one end to a pivot member 47 which is fixably mounted to the larry car structure (not shown). Pivot arm 46 is pivotally attached at its other end to one end of a second pivot arm 48 which is, in turn, attached to pivot support member 40 on gate member 37.

Figure 6:
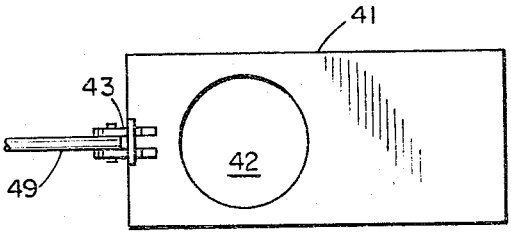
FIG. 6 is a top view of the first gate member.

A gate member plate 41, FIGS. 6 and 1, of a generally rectangular configuration, is slidably mounted to guide bars 33. Gate member 41 has a hole 42 off-set to the left, as viewed in FIG. 6. The radius of hole 42 is equal to the radius of hole 53 in guide plate 32. A pivot member 43 is fixably mounted by any conventional means to the left longitudinal extreme of gate member 41.

Gate member 41 is motivated to assume different positions along guide plate 32 by hydraulic cylinder 49 which is mounted at one end to member 50 which is, in turn, fixably mounted by any conventional means to the under side of guide plate 22. The other end of hydraulic cylinder 49 is pin mounted to pivot member 47, mounted to plate 41.

Figure 7:
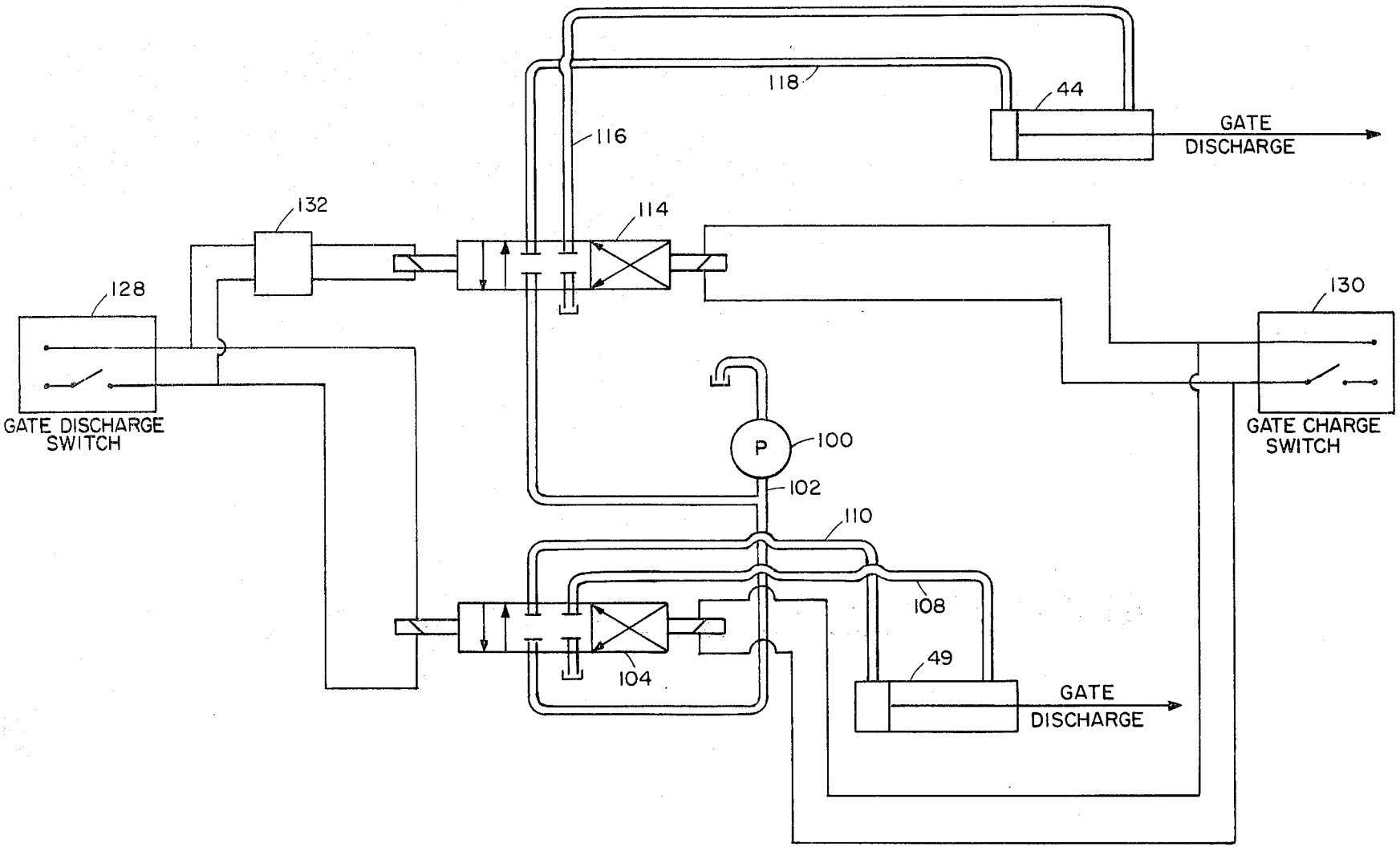
FIG. 7 is a schematic of the activation system for the first and second gates.

Referring to FIGS. 1 and 7, when hopper 11 is being charged with a granular material, gate members 41 and 37 are in the charging position. The charging position positions gate member 37 to the left such that the arched slots 39 are in the hopper flow path. The gate member 41 is positioned to the left, as viewed in FIG. 1, thereby blocking flow from the hopper 11 by blocking flow between hopper sections 17 and 19. To discharge hopper 11 the gate members 37 and 41 are repositioned such that their respective holes 38 and 42 are aligned to the flow path.

FIG. 8 shows a preferred combined electrical and hydraulic schematic diagram for automatically activating gate assemblies 21 and 31. Pump 100 supplies hydraulic fluid via line 102 to a four-way solenoid operated valve 104 under control to supply fluid under pressure to a cylinder 49 via line 108 and eventually a sump (not shown) via line 100, as is well known, to cause gate member 41 to assume a discharge position in response to motion of cylinder 49. Gate member 41 will assume a charging position when solenoid valve 104 is reversed, causing cylinder 49 to operate in the reverse direction, as is well known.

Subsequent to the operation of gate system 31, pump 100 supplies hydraulic fluid via line 102 to a four-way solenoid operated valve 114 under control to supply fluid under pressure to cylinder 44 via line 116 and eventually to a sump (not shown) via line 118, as is well known, to cause gate member 26 to assume a discharge position in response to motion of cylinder 44. Gate member 37 will assume a charging position when solenoid valve 114 is reversed and cylinder 44 operates in the reverse direction, as is well known.

Solenoid valves 104 and 114 are energized from a power source (not shown) under the control of switches 128 and 130. Gate discharging switch 128 activates solenoid valve 104 to stimulate gate member 41 to a discharge mode. Gate discharging switch 120 delay-activates solenoid valve 114, due to the presence of a conventional time-delay circuit 132 in the system, to stimulate gate member 37 to a discharge mode. The time-delay circuit has the capacity to time-delay to any preset time interval. Activation of switch 130 activates solenoids 104 and 114 to simulate gate members 41 and 37 to assume a charging position.

The lag time between activation of gate member 41 and gate member 37 is calculated to assure that the descent of granular material supported by gate member 37 is not sufficiently inhibited by the material remaining in hopper 17 to permit arching, and yet, have no adverse effects on discharge time of the hopper. The proper lag time is calculable by one reasonably skilled in the art and is dependent on average particulate size and moisture content of the granular material in the hopper 11.

One skilled in the art can ascertain the proper dimension for slots 39 contained in gate member 37, which is predicated on the average particulate size and moisture content of a granulated material. Gate member 37 is interchangeable to allow the hopper to accommodate granular material of differing average particulate sizes and moisture content.

As earlier intimated, when hopper 11 is charged with a granular material, and during hopper transport, the gate members 37 and 41 are in the aforedescribed charging position. In the charging position slots 39 contained in gate member 37 allow a sizable portion of the granular material to be deposited in hopper section 17, thereby allowing hopper 11 to quantitatively contain a substantially equal amount of material as contained by conventional hoppers without alteration of the physical dimensions of hopper 11. To discharge the granular material from hopper 11, switch 128 is activated, causing hydraulic cylinder 49 to position gate member 41 to the aforedescribed discharge position. Activation of switch 128 also causes hydraulic cylinder 44 to position gate member 37 to the aforedescribed discharge position subsequent to the positioning of gate member 41. The time interval between the positioning of gate members 41 and 37 is a matter of choice. After the hopper 11 has discharged the granular material, activation of switch 130 causes hydraulic cylinders 44 and 49 to reposition gate members 37 and 41, respectively, to the aforedescribed charging position.

We claim:

1. A gravity motivated hopper movable from one location to another, to alleviate the propensity for hopper-contained granular material to compact and arch in the critical arching dimension of said hopper, comprising:

(a) a hopper with a hollow interior having a bottom section vertically oriented with vertically decreasing cross-section areas defining a discharge flow path leading to a bottom opening;

(b) first gate means for closing said opening while said hopper is being charged with granular material and during transport of said material to a discharge location;

(c) second gate means spaced above such first gate means so that said critical arching dimension is between said gates, said second gate means incompletely closing said hopper during the discharging and transportation of said granular material so as to allow a portion of said granular material to be deposited between said gates while providing support for the remaining portion of granular material in said hopper and thereby preventing arching conditions of said granular material from developing in said critical dimension area; and (d) means for slidably motivating said second gate means to a discharge position for allowing unobstructed flow through said second gate means during discharge of said granular material from said bottom opening.

2. A gravity hopper as claimed in claim 1, wherein said second gate means comprises:

(a) a guide plate with a hole extending throughout the generally uniform thickness of said guide plate, said guide plate being fixably mounted to said hopper bottom section above said critical arching area, said guide plate extending across said flow path, said guide plate hole sized and positioned to permit unobstructed flow through said flow path;

(b) a gate member slidably mounted to said guide plate, said gate member having a plate configuration of uniform thickness with a hole thoughout the thickness of said gate member and a plurality of arch-shaped slots extending through the thickness of said gate member aligned beside said hole in a generally circular configuration, said hole and said circular configured slots are sized to approximate equal said guide plate hole; and (c) position means for slidably positioning said gate member along said guide plant.

3. A gravity hopper as claimed in claim 2 further comprising means to motivate said position means at a predetermined interval after said first gate means assumes discharge of said granular material.

* * * * *